US009863641B2

(12) United States Patent
Boyd

(10) Patent No.: US 9,863,641 B2
(45) Date of Patent: Jan. 9, 2018

(54) HEATING APPLIANCE WITH LIGHT AND SOUND AND CORRESPONDING METHOD

(71) Applicant: MARLEY ENGINEERED PRODUCTS LLC, Bennettsville, SC (US)

(72) Inventor: Michael P. Boyd, Orland Hills, IL (US)

(73) Assignee: MARLEY ENGINEERED PRODUCTS LLC, Bennettsville, SC (US)

( * ) Notice: Subject to any disclaimer, the term of this patent is extended or adjusted under 35 U.S.C. 154(b) by 0 days.

(21) Appl. No.: 14/802,117

(22) Filed: Jul. 17, 2015

(65) Prior Publication Data

US 2017/0016612 A1 Jan. 19, 2017

(51) Int. Cl.

| | |
|---|---|
| ***F21V 33/00*** | (2006.01) |
| ***F24C 7/06*** | (2006.01) |
| ***G08B 13/196*** | (2006.01) |
| ***H05B 33/08*** | (2006.01) |
| ***F21V 23/00*** | (2015.01) |
| ***G08B 5/36*** | (2006.01) |
| ***G08B 17/10*** | (2006.01) |
| ***G08B 17/117*** | (2006.01) |
| *F21V 23/04* | (2006.01) |
| *F21Y 101/02* | (2006.01) |
| *F21W 121/00* | (2006.01) |
| *F21Y 103/10* | (2016.01) |
| *F21Y 115/10* | (2016.01) |
| *F21Y 113/13* | (2016.01) |

(52) U.S. Cl.

CPC ..... *F24C 7/06* (2013.01); *F21V 23/003* (2013.01); *G08B 5/36* (2013.01); *G08B 13/19697* (2013.01); *G08B 17/10* (2013.01); *G08B 17/117* (2013.01); *H05B 33/08* (2013.01); *F21V 23/0435* (2013.01); *F21V 23/0442* (2013.01); *F21V 33/006* (2013.01); *F21V 33/0076* (2013.01); *F21W 2121/00* (2013.01); *F21Y 2101/02* (2013.01); *F21Y 2103/10* (2016.08); *F21Y 2113/13* (2016.08); *F21Y 2115/10* (2016.08)

(58) Field of Classification Search

CPC ..... F21Y 2101/00; H01R 13/7175; H01R 2103/00; H01R 24/76; H02G 3/20; H05B 33/086

USPC ..... 362/92

See application file for complete search history.

(56) References Cited

U.S. PATENT DOCUMENTS

| | | | | |
|---|---|---|---|---|
| 8,214,084 B2 * | 7/2012 | Ivey | ..... | H05B 33/0803 362/276 |
| 2015/0022996 A1 * | 1/2015 | Kang | ..... | F21V 33/0092 362/23.14 |

* cited by examiner

*Primary Examiner* — William Carter

(74) *Attorney, Agent, or Firm* — Baker & Hostetler LLP

(57) ABSTRACT

A heater includes: a controller; a user input operatively connected to the controller; and a lighting system operatively connected to, and controlled by, the controller, the lighting system configured to illuminate outside the heater along a length of the heater. A method of displaying light includes: attaching a lighting system to a heater; operatively connecting the lighting system to a controller; operatively connecting a user input device to the controller; and configure the controller to illuminate the light system to provide indirect lighting to a room in which the heater is located.

18 Claims, 7 Drawing Sheets

HEATING APPLIANCE WITH LIGHT AND SOUND AND CORRESPONDING METHOD

FIELD OF THE INVENTION

The present invention relates generally to an appliance that can output light, sound, and/or a variety of alarms. More particularly, the present invention relates to an appliance that can broadcast aesthetically pleasing light as well as light having specific meaning to indicate different types of alarms as well as music and other sound that may be desirable for listening as well as for alarm purposes.

BACKGROUND OF THE INVENTION

Homes and businesses are always looking to upgrade the living spaces of buildings. Aesthetically pleasing features such as light and sound can create a more pleasant living environment. Furthermore, it may be desirable to have safety, security features, and monitor systems that will be able to indicate to people in the living area of the building whether a fault has been detected. Accordingly, it is desirable to provide a method and apparatus that can indicate system faults to people located in the living area while enhancing the aesthetics of the living area.

SUMMARY OF THE INVENTION

The foregoing needs are met, to a great extent, by embodiments in accordance with the present disclosure, wherein in one aspect an apparatus is provided that, in some embodiments, a method and apparatus that can indicate system faults to people located in the living area while enhancing the aesthetics of the living area.

In accordance with one embodiment of the present invention, a heater includes: a controller; a user input operatively connected to the controller; and a lighting system operatively connected to, and controlled by, the controller, the lighting system configured to illuminate outside the heater along a length of the heater.

In accordance with another embodiment of the present invention, a method of displaying light includes: attaching a lighting system to a heater; operatively connecting the lighting system to a controller; operatively connecting a user input device to the controller; and configure the controller to illuminate the light system to provide indirect lighting to a room in which the heater is located.

In accordance with yet another embodiment of the present invention, a heater is provided. The heater includes: a means for controlling; a means for imputing commands into the means for controlling operatively connected to the means for controlling; and means for creating light operatively connected to, and controlled by, the means for controlling, the means for creating light being configured to illuminate outside the heater along a length of the heater.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
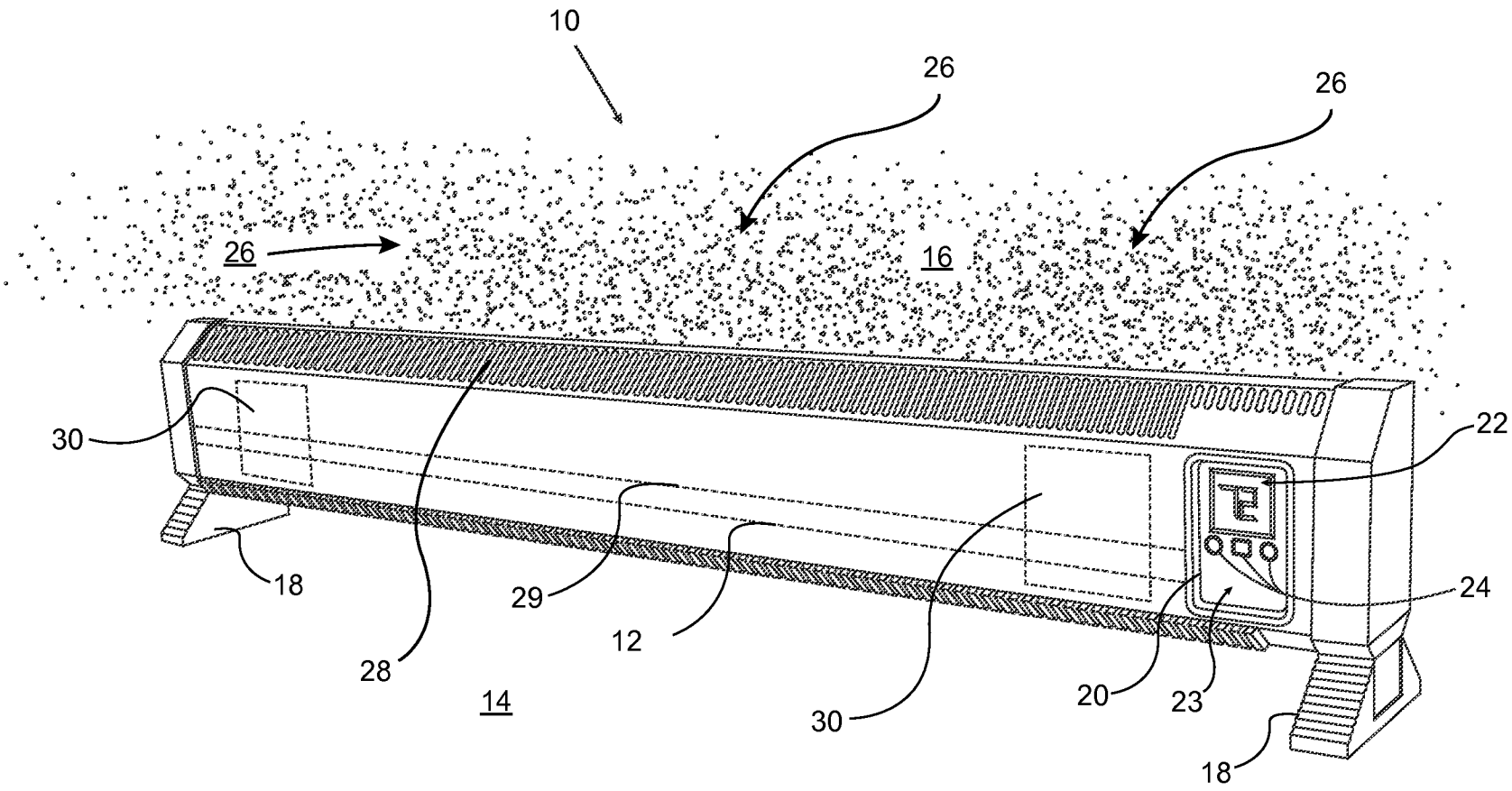
FIG. 1 is a perspective view of a heater illuminating an adjacent space in accordance with the present disclosure.

The invention will now be described with reference to the drawing figures, in which like reference numerals refer to like parts throughout. An embodiment in accordance with the present invention provides a heater that is configured to illuminate an area adjacent to the heater. In some embodiments, the heater may provide illumination for aesthetic reasons, to create mood lighting, to provide a holiday decoration, or to activate an alarm. In some embodiments, the heater may also include speakers which may provide music, perform a reminder function, or an alarm function.

FIG. 1 illustrates a light emitting appliance 10 in accordance with the present disclosure. The light emitting appliance 10 is a base heater 12. In other embodiments, other types of heaters or other appliances may also be used. The base heater 12 sits on a floor 14. The light emitting appliance is located near an adjacent wall 16.

The heater 12 is supported on the floor 14 by feet 18. In other embodiments, other means of support may also be used. The base heater 12 has a control panel 20. The control panel 20 may include a display screen 22 and, in some embodiments, have a user input device 23 which may include input keys 24. In other embodiments, the display screen 22 may be a touchscreen and thus the user input may be done via the display screen 22.

The light emitting appliance 10 may emit light 26 to an adjacent space. (In the figures, emitted light shining on a surface is indicated by stippling 26, 36, 38, and/or 40 and emitted light when shown emitting from a light source but not on a surface is indicated by light rays 26.) For example, in some embodiments, the light emitting appliance 10 may emit light 26 toward the adjacent wall 16. In other embodiments, (which will be discussed further below with respect to FIG. 4) the base heater 12 may emit light 26 toward the floor 14. In some embodiments, the emitted light 26 may all be the same color. In other embodiments, multiple colors may be emitted. In some embodiments, the light 26 may be steady and other embodiments the light 26 may blink, flash, twinkle, or perform some other dazzling feature.

As shown in FIG. 1, the base heater 12 may optionally include a grill 28 which allows air to circulate with heating elements 29 contained within the base heater 12. In some embodiments a fan or blower 31 (shown in FIG. 9) may be located in the appliance and configured to move air over the heating elements 29 and through the grill 28. Optionally, the base heater 12 may also include speakers 30 which may be configured to broadcast music, voice, and/or audible alarm signals.

Figure 2:
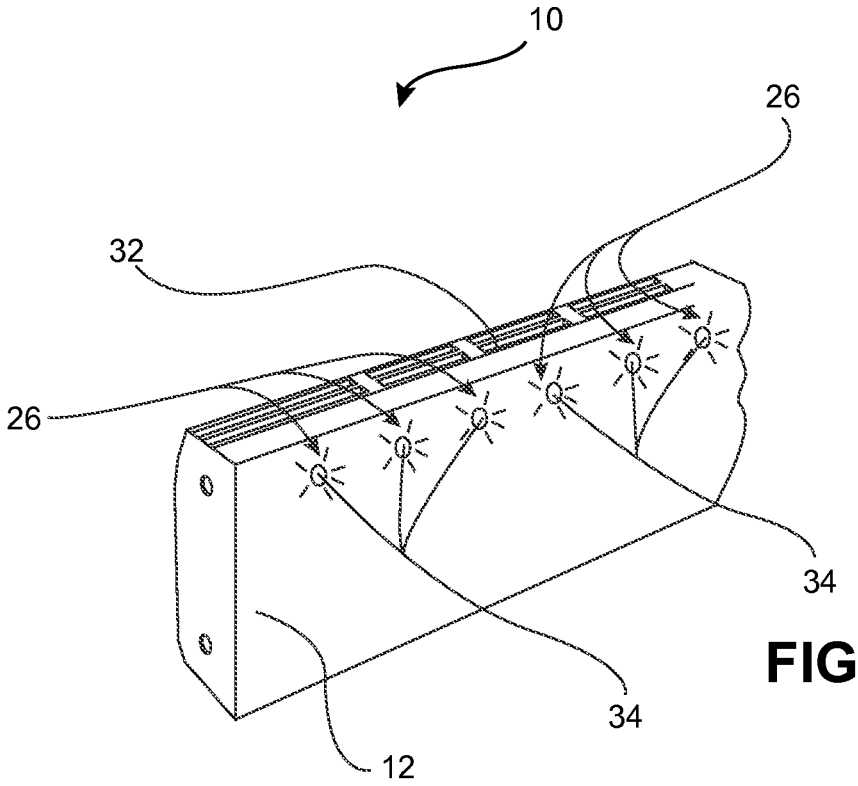
FIG. 2 is a rear view of a heater having a plurality of lights in accordance with the present disclosure.

FIG. 2 illustrates a partial rearview of the base heater 12. Lights 34 are attached to the base heater 12 and provide the emitted light 26. In some embodiments, the lights 26 may be incandescent, fluorescent, light emitting diode (LED) or any other suitable lighting elements. In some embodiments, attaching lights 34 to a base heater 12 can include integrating the lights 34 with the base heater 12. In other embodiments, attaching lights 34 to a base heater 12 includes attaching a lighting system to a base heater 12, such as, for example, the lights 34 may be part of a light strip 32 applied to the heater 12. In other embodiments lights 34 may be individually attached to the heater 12 and not part of a light strip 32 or other self-contained light system.

Figure 3:
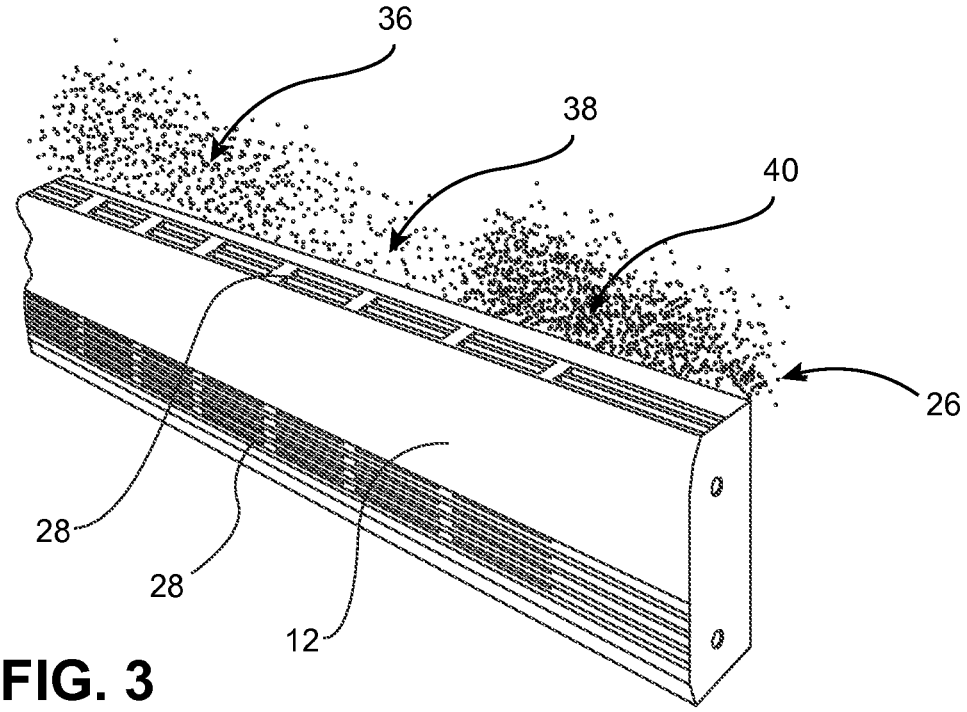
FIG. 3 is a partial perspective view of a portion of the heater illuminating and adjacent wall space with a variety of different colored lights in accordance with the present disclosure.

FIG. 3 is a partial view of a base heater 12 having multiple grills 28. The base heater 12 emits various colors 36, 38, and 40 of emitted light 26. The various colors 36, 38, and 40 can be any number of different colors. For example if the colors were red 36, white 38, and blue 40, the emitted light 26 may provide a patriotic theme and would be suitable for a Fourth of July or other patriotic holiday in the United States of America. Other colors 36, 38, and 40 may also be used, for example, orange and black could be used for Halloween, red and green may be used for Christmas, purple, light blue, light yellow or any other pastel or other suitable colors may be used for Easter. Red may be used for Valentine's Day, and green maybe used for St. Patrick's Day. Other colors may be used as set by the user. While three different colors of light have been described here, it should be understood that greater or fewer different colors maybe used in various embodiments. Various colors may be used as accent lighting mood lighting and/or nightlights. In addition other colors, twinkling, and/or blinking light 26 may be used to indicate an alert or alarm.

Figure 4:
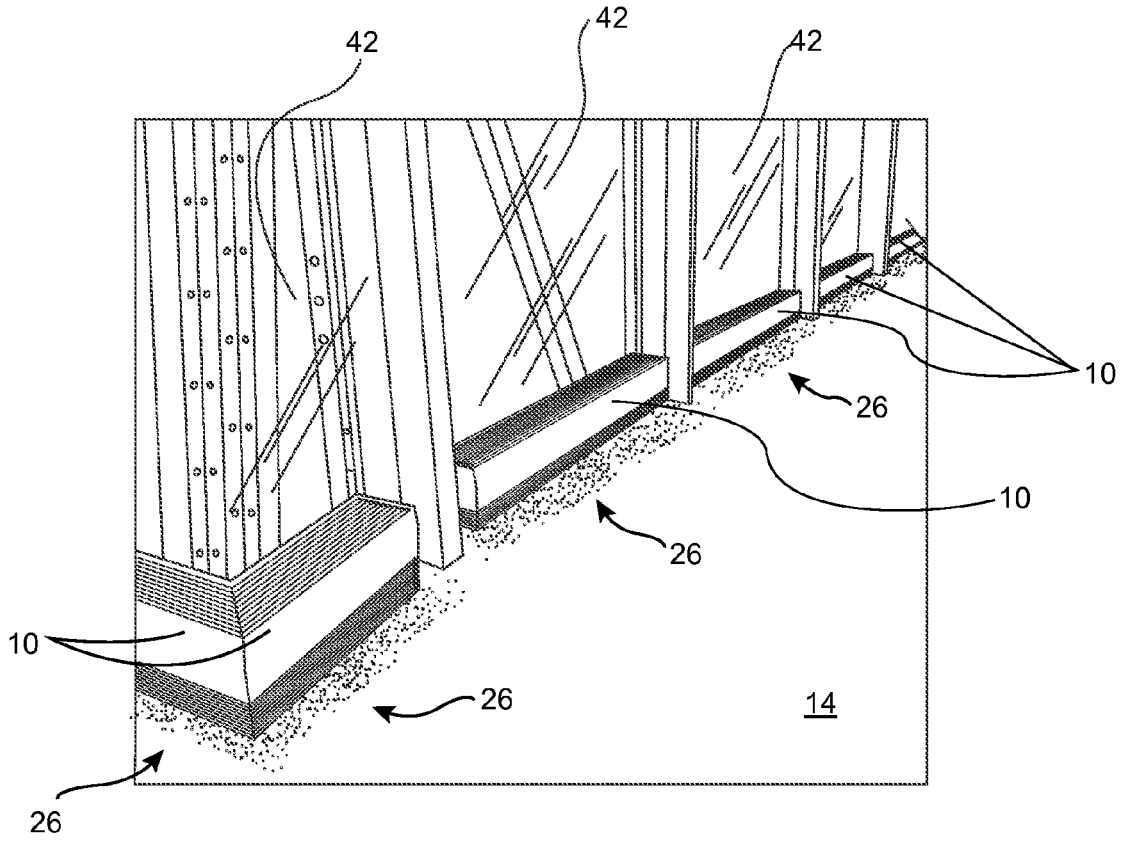
FIG. 4 is a perspective view of variety of heaters illuminating an adjacent floor space in accordance with the present disclosure.

FIG. 4 illustrates an alternative light emitting appliance 10. As shown in FIG. 4, the light emitting appliance 10 may also be a heater, but rather than emitting light towards an adjacent wall 16 shown in FIG. 1, the light 26 may be omitted downwardly toward the floor 14. The light emitting appliance 10 may in some installations, be located near windows 42 rather than a wall 16 as shown in other embodiments described herein, the light emitting appliance 10 of FIG. 4 may also be located adjacent to walls 16. Various options and combinations and locations may be used according to a user's preference.

Figure 5:
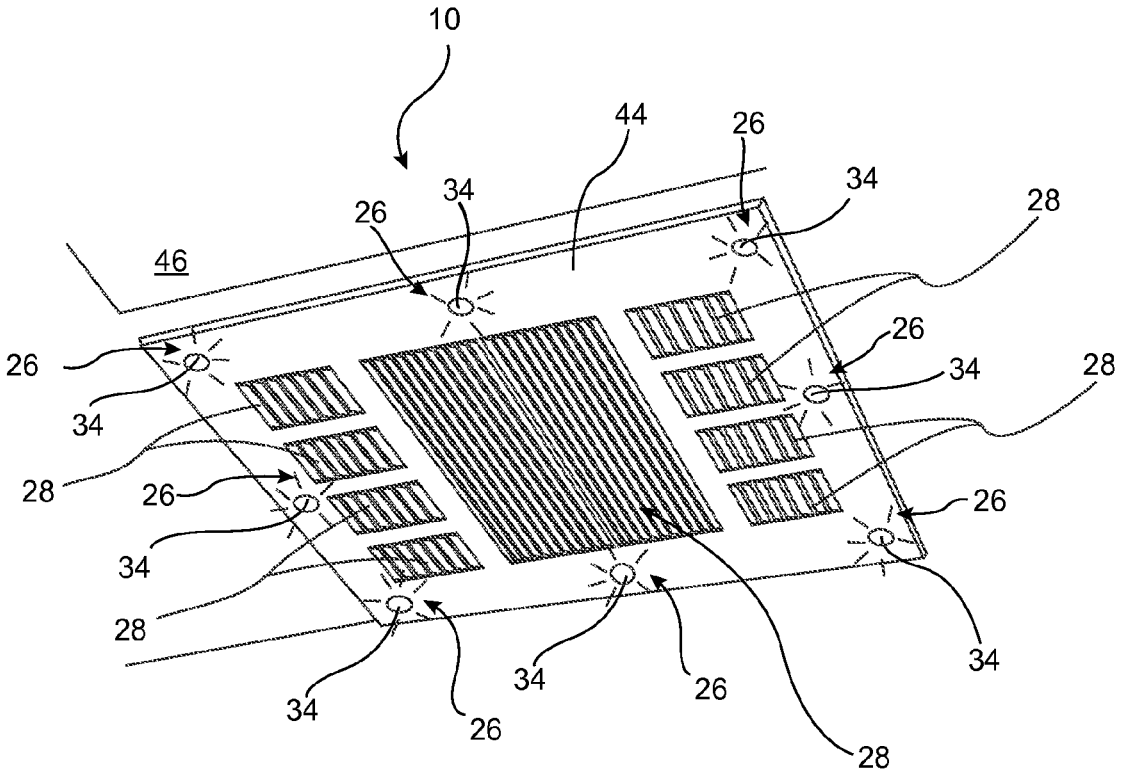
FIG. 5 is a perspective view of a ceiling mounted heater in accordance with the present disclosure.

FIG. 5 illustrates an alternative embodiment where the light emitting appliance 10 is a ceiling unit 44 heater located on a ceiling 46. The ceiling unit 44 may include various grills 28. The ceiling unit 44 may be equipped with lights 34 that emit light 26 and a fashion similar to that described above. In some embodiments, the ceiling unit may emit light onto a ceiling 46 or adjacent wall 16.

Figure 6:
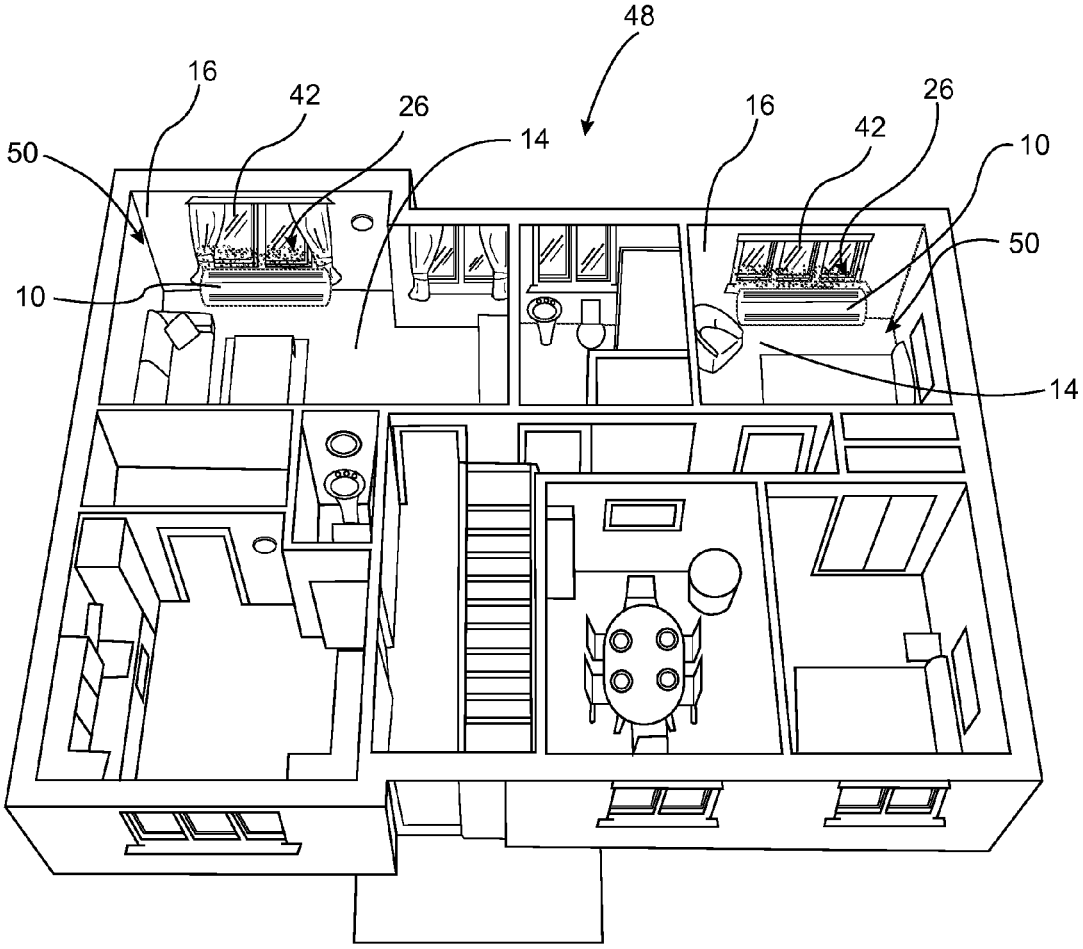
FIG. 6 is a perspective, cut away view of an example house equipped with a heater in accordance the present disclosure.

FIG. 6 is an example cutaway view of a building or home 48. The building or home 48 may include various rooms 50 into which a light emitting appliance 10 may be installed. As shown in FIG. 6, the light emitting appliance 10 may be installed adjacent to a floor 14, windows 42, or a wall 16. The light emitting appliance 10 emits light 26 in a manner similar to that described herein.

Figure 7:
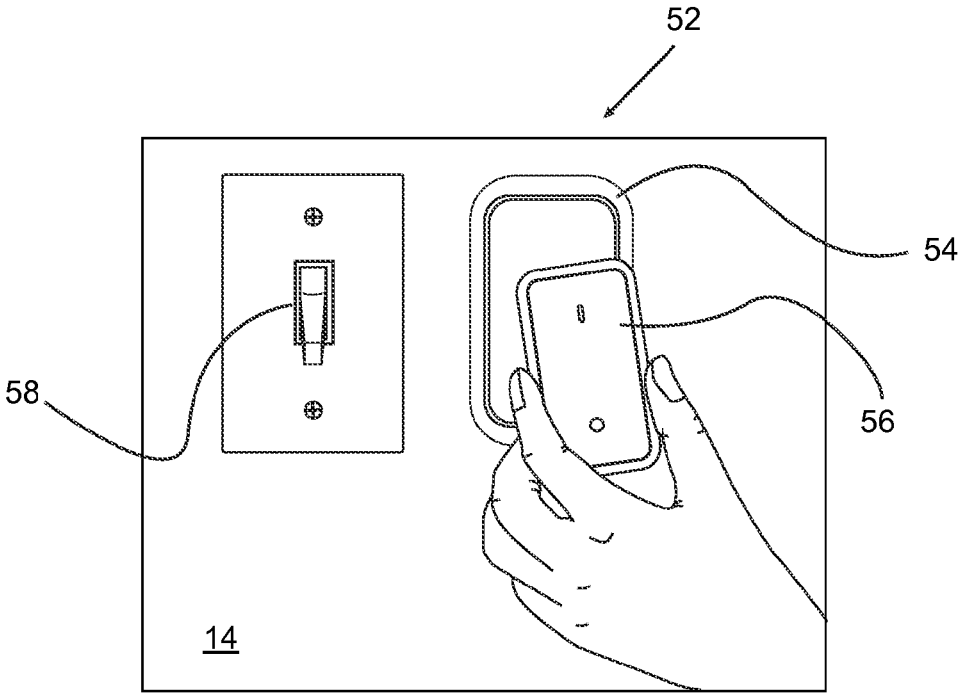
FIG. 7 is a perspective view of a remote control in accordance of the present disclosure.

FIG. 7 illustrates various optional remote control systems 52 for controlling the light emitting appliance 10 (not shown in FIG. 7). The control system 52 may include an optional storage bracket 54 which is configured to provide a mounting for a remote unit 56. The remote unit 56 is operatively connected to the light emitting appliance 10 in order to control the light emitting appliance 10. The remote unit 56 may be configured to communicate with the light emitting appliance 10 wirelessly or via a wired connection. The light emitting appliance 10 may be controlled to vary how much heat is being emitted by the light emitting appliance 10 by controlling the heating elements 29 and/or the fan or blower 31 (see FIG. 9). Further, the intensity, brightness, color, blinking, twinkling, or other patterns of the emitted light 26 may also be controlled by the remote unit 56. In some optional embodiments, the remote unit 56 may also allow a user to control the speakers 30 in order to adjust the volume, turn the speakers 30 on and off, and select which music or audio signals are emitted from the speakers 30.

In other optional embodiments, a standard switch 58 or series of switches may be used to control the light emitting appliance 10 in a manner to that similar to that described above. The standard light switch 58 may be operatively connected to the light emitting appliance 10 via wires or wirelessly.

Figure 8:
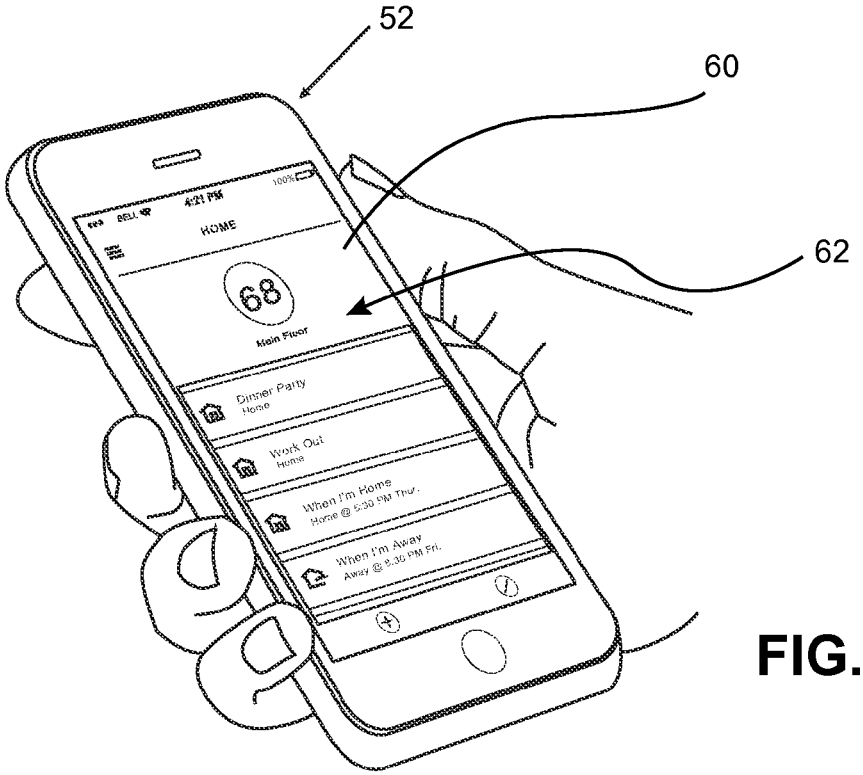
FIG. 8 is a perspective view of a smart device modified to interact with a heater in accordance of the present disclosure.

FIG. 8 illustrates a portable smart device 60 which may be used as a remote system 52. In some embodiments, the remote system 52 as shown in FIG. 8 may be a smart phone 60, a tablet computer, a laptop, a desk top computer or any other smart type device or computer 60. Optionally, the smart device 60 may have a touch screen 62 that may allow a user to input commands into the smart device 60 which may transmit those commands to the light emitting appliance 10. The remote system 52 as shown in FIG. 8 may communicate wirelessly or via wire to the light emitting appliance 10 in order to control the light emitting appliance similar to the remote system 52 described above with respect to FIG. 7.

Figure 9:
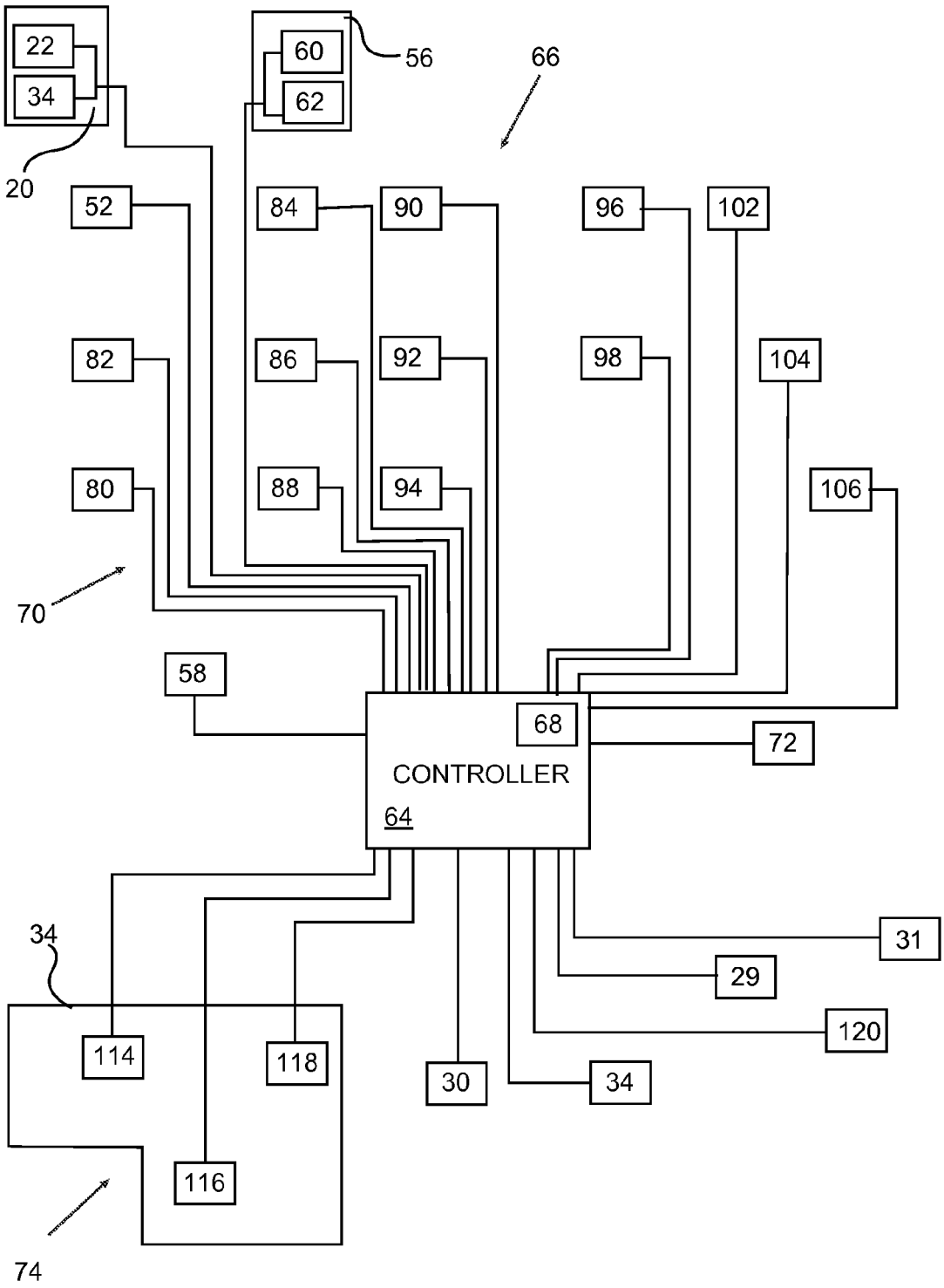
FIG. 9 is a schematic diagram illustrating various components attached to the controller in accordance with the present disclosure.

In some embodiments, the light emitting appliance 10 may be controlled by a microcontroller 64 as shown in the schematic diagram 66 in FIG. 9. The microcontroller 64 may include a timing function 68 and various inputs 70. The timing function 68 may allow the controller 64 to output control signals at various periodic intervals. The microcontroller 64 may use signals received from the timing function 68 and\or various inputs 70 to control lighting systems 34 operatively connected to the controller 64, a heating element 29 associated with the light emitting appliance 10, and/or a fan or blower 31 associated with the light emitting appliance 10 to have the light emitting appliance 10 put off a desired amount of heat, light, and/or sound.

A variety of inputs 70 may be operatively connected to the controller 64 to input control signals to the controller 64. The controller 64 will process the signals according to settings which may be preprogrammed and the controller 64 or programmed or modified by a user. The processing of the input signals will result in control signals being sent from the controller 64 to various features such as heating elements 29 associated with the light emitting appliance 10 various lighting systems 34 which may include a subset lighting systems 114, 116, 118, speakers 30 and an alarm system 120 which may include one or both the lighting system 34 and speakers 30.

The inputs 70 will be described in detail below. It should be understood that some embodiments may include all, none, or some of the example inputs 70 described. Other embodiments may include other inputs that may not be described herein. Inputs 70 to the controller 64 may include the control panel 20, including the display (which also may be in output 74 from the controller 64 to display information to a user), and input keys 24 and/or a touchscreen 62. Additional inputs 70 include various remote control systems 52, for example, remote units 56 which may include switches 58, smart devices 60, and their corresponding touch screens 62. These devices may also be outputs and is much as they may display information to a user. The remote control 56, the switch 58, the control panel 20 with its display 22 and input keys 24, and/or smart device 60 described above may be operatively connected to the microcontroller 64 in order to allow a user to put control input signals into the controller 64. By using one or more of the input keys 24, remote unit 56, and switch 58, and/or smart device 60 a user may control or program the controller 64 to control the outputs 74.

One example input 70 may be other lighting systems 72. By having an input 70 of other lighting systems 72 the controller 64 can coordinate a lighting effect with other lighting systems 72. For example, as shown in FIG. 4, several light emitting appliances 10 are located adjacent to each other. In such instances the various light emitting appliances 10 can coordinate their operation.

Additional inputs may include sensors 80 associated with appliances, a sound sensor 82, a smoke sensor 84, a motion detector 86, and odor sensor 88, a light sensor 90, door sensor 92, doorbell sensor 96, phone sensor 98, a window sensor 94, the carbon monoxide sensor 102, a radon sensor 104, and other sensors 106. The sensors 80 associated with other appliances may be associated for example with an oven, coffee maker, or any other suitable kitchen type appliance and activate the controller 64 to indicate that the food or drink is finished cooking or brewing. When the appliance sensor 80 sends a signal to the microcontroller 64 the microcontroller can activate one or both of the lights 34 and speakers 30 to indicate the kitchen appliance has completed its cycle.

A sound sensor 82 may be used to provide a signal to the controller 64 to detect an ambient amount of sound so that the controller 64 can set the speakers 30 to an appropriate volume in view of the ambient sound. The speakers 30 may also be controlled to perform a noise cancelling function.

Sensors such as the smoke sensor 84, the carbon monoxide sensor 102, and the radon sensor 104, may be operatively connected to the controller 64 to cause the controller to activate one or both of the speakers 30 and lights 34 for some other audible alarm 120 to indicate that one of those sensors 84, 102, and 104, have detected smoke, carbon monoxide, or radon.

The door and window sensors 92 and 94 may be operatively connected to doors or windows and detect whether a door or window has been opened. Optionally, the window sensor 94 may also detect if the window has been broken. If the sensors 92 or 94 detect an open door or window or a broken window, these sensors 92 and 94 can send a signal to the microcontroller 64 to cause one or more of the speakers 30, lights 34 or other alarm 120 to activate.

The motion detector 86 may be operatively connected to the microcontroller 64 to cause the microcontroller 64 to activate at least one of the speakers 30, lights 34, and/or other alarms 120 when motion is detected. The odor sensor 88 may be operatively connected to the microcontroller 64 to cause the microcontroller 64 were to activate at least one of the speakers 30, lights 34, and/or other alarms 120 when an odor is detected. The light sensor 90 can detect an ambient light condition in which the light emitting appliance 10 is placed. Based on the ambient light in which the light emitting appliance 10 is placed the light sensor 90 may send a signal to the controller 64 which may then modify the intensity of the lights 34. For example if the ambient light condition is relatively dark then the lights 34 may be adjusted to be not so bright. On the other hand if the ambient light condition is relatively bright the lights 34 may be made to be more bright so they can be distinguished from the ambient light in which the light emitting appliance 10 is located.

Doorbell sensors 96 an/or phone sensors 98 may be operatively connected to the microcontroller 64 to cause the microcontroller 64 to activate at least one of the speakers 30, lights 34, and/or other alarms 120 when the doorbell in the building where the light emitting appliance 10 is rung or a phone in the building where the light emitting appliance 10 is located rings.

Other sensors or inputs 106 may be associated with the light emitting appliance 10 and operatively connected to the microcontroller 64 to cause the microcontroller 64 to activate and or adjust the speakers 30, lights 34, and or other alarms 120.

In some embodiments the other sensors or inputs 106 may allow the appliance 10 to operate in conjunction with other systems. For example, a home security system may tie in or be connected to the appliance 10. When the home security system detects a breech, the appliance 10 may work in unison with the security system to operate the sound and/or lights in an alarm mode. Other systems such as smoke detecting systems may also be connected to the controller 67 to cause the sound and/or lights to operate in an alarm mode when the smoke detector system detects smoke. These external security systems, smoke detecting systems, and other systems may be external to the appliance 10 and may be mode and/or marketed by other entities than that of the appliance 10.

One of ordinary skill the art after reviewing this disclosure will understand that any of the inputs 70 including sensors, remote control systems 52 including switches 58 remote units 56 and smart devices 60 can cause the controller 64 to manipulate any of the outputs 74 of the light emitting appliance 10 including colors, blinking, flashing, moving, of the emitted light 26, the heat put off by the heating elements 29, sound put off by the speakers 30, the speed of the fan or blower 31, the other alarm systems 120 or any other output 74 of the light emitting appliance 10.

Although an example of the device is shown as being a heater, the light emitting appliance is not limited to heaters. Outputs such as lights, sound, alarms, and any other output described herein may be applied to any other appliance.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A heater having a length comprising:

a controller;

a user input operatively connected to the controller;

a lighting system operatively connected to, and controlled by, the controller, the lighting system configured to emit light to illuminate a surface adjacent the heater along the length of the heater such that the light illuminating the surface is visible; and a sensor operatively connected to the controller, and the controller is configured to control the lighting to visibly illuminate a specific lighting sequence when a signal is provided to the controller from the sensor, wherein the sensor includes a smoke alarm and the controller is configured to control the lighting system to generate a visible warning display in response to the signal from the smoke alarm.

2. The heater of claim 1, wherein the controller is configured to control the lighting system to provide light having a single color.

3. The heater of claim 1, wherein the controllers configured to control the lighting system to provide light of various colors.

4. The heater of claim 1, wherein the lighting system is comprised of LED lighting.

5. The heater of claim 1, where in the lighting system is oriented to provide indirect lighting to a room in which the heater is installed.

6. The heater of claim 1, further comprising an additional sensor operatively connected to the controller, and the controller is configured to control the lighting to illuminate a second alternate lighting sequence when a signal is provided to the controller from the additional sensor.

7. The heater of claim 6, wherein the additional sensor is anyone of the following sensors: an additional smoke sensor, a motion sensor, and odor sensor, a light sensor, a carbon monoxide sensor a radon sensor, a sensor indicating whether a doorbell has been activated, a sensor indicating whether a window has been moved, a sensor indicating whether a door has moved, a sensor indicating whether a phone is receiving a phone call.

8. The heater of claim 1, wherein the sensor is associated with an appliance located in a same building as the heater.

9. The heater of claim 1, wherein the controller is configured to control the lighting system to provide illumination according to a default sequence.

10. The heater of claim 9, further comprising a sensor operatively connected to the controller, and the controller is configured override the default sequence and to control the lighting to illuminate an alternate lighting sequence when a signal is provided to the controller from the sensor.

11. The heater of claim 1, wherein the controller is configured to control the lighting system to perform any one of the following functions: blink, change colors, remain on in a steady-state.

12. The heater of claim 1, further comprising an audio speaker operatively connected to the controller.

13. The heater of claim 12, wherein the speaker is configured to emit both music and an audible alarm.

14. The heater of claim 1, further comprising a remote control configured to communicate with the controller and provide input signals to the controller.

15. The heater of claim 14, wherein the remote control is one of any of the following:

a mobile phone, a computer, a tablet computer, and a dedicated remote control.

16. A method of displaying light comprising:

attaching a lighting system to a heater;

operatively connecting the lighting system to a controller;

operatively connecting a sensor to the controller, the controller being configured to control the lighting to visibly illuminate a specific lighting sequence when a signal is provided to the controller from the sensor, wherein the sensor includes a smoke alarm;

operatively connecting a user input device to the controller; and configuring the controller to illuminate the light system to project light on a surface other than the heater such that the surface forms a visible light display and configuring the controller to control the lighting system to generate a visible warning display in response to the signal from the smoke alarm.

17. The method of claim 16, further comprising operatively connecting an audio speaker to the controller.

18. A heater having a length comprising:

a means for controlling;

a means for imputing commands into the means for controlling operatively connected to the means for controlling;

means for creating light operatively connected to, and controlled by, the means for controlling, the means for creating light being configured to emit light to illuminate a surface adjacent to the heater such that the light illumining the surface is visible along the length of the heater; and a sensor means operatively connected to the means for controlling, and the means for controlling is configured to control the means for creating light to visibly illuminate a specific lighting sequence when a signal is provided to the controller from the sensor, wherein the sensor includes a smoke alarm and the means for controlling is configured to control the means for creating light to generate a visible warning display in response to the signal from the smoke alarm.

* * * * *